US006029035A

United States Patent [19]

Akichika et al.

[11] Patent Number: 6,029,035

[45] Date of Patent: Feb. 22, 2000

[54] ELECTROSTATIC RECORDER

[75] Inventors: Yoshinori Akichika, Tokyo; Toshitatsu Kawatsu; Kiyotsugu Takasawa, both of Suwa-gun; Fumito Komatsu, Shiojiri, all of Japan

[73] Assignee: Nippon Steel Corporation, Tokyo, Japan

[21] Appl. No.: 09/065,050

[22] PCT Filed: Oct. 29, 1996

[86] PCT No.: PCT/JP96/03164

§ 371 Date: Apr. 27, 1998

§ 102(e) Date: Apr. 27, 1998

[87] PCT Pub. No.: WO97/16317

PCT Pub. Date: May 9, 1997

[30] Foreign Application Priority Data

| | | | |
|---|---|---|---|
| Oct. 30, 1995 | [JP] | Japan | 7-281841 |
| Oct. 30, 1995 | [JP] | Japan | 7-281842 |
| Oct. 30, 1995 | [JP] | Japan | 7-281845 |

[51] Int. Cl.[7] ..... G03G 15/10

[52] U.S. Cl. ..... 399/237; 399/249

[58] Field of Search ..... 399/237, 238, 399/239, 249, 233; 430/117–119

[56] References Cited

U.S. PATENT DOCUMENTS

| | | | |
|---|---|---|---|
| 4,127,082 | 11/1978 | Kawabata | 399/239 |
| 4,289,092 | 9/1981 | McChesney et al. | 399/247 |
| 4,733,273 | 3/1988 | Lloyd | 399/239 |
| 5,016,036 | 5/1991 | Nishikawa . | |
| 5,300,990 | 4/1994 | Thompson | 399/240 |
| 5,713,068 | 1/1998 | Teschendorf et al. | 399/249 |

FOREIGN PATENT DOCUMENTS

| | | |
|---|---|---|
| 0092107 | 10/1983 | European Pat. Off. . |
| 0175392 | 3/1986 | European Pat. Off. . |
| 0226213 | 6/1987 | European Pat. Off. . |
| 0578243 | 1/1994 | European Pat. Off. . |
| 47-18008 | of 1972 | Japan . |
| 59-131951 | of 1984 | Japan . |
| 4-159570 | of 1992 | Japan . |
| 4-503265 | of 1992 | Japan . |
| 6-274044 | 9/1994 | Japan . |

*Primary Examiner*—Robert Beatty
*Attorney, Agent, or Firm*—Pollock, Vande Sande & Amernick

[57] ABSTRACT

An electrostatic recorder includes electrostatic latent image recorder elements for forming an electrostatic latent image on a recording medium conveyed at a predetermined speed, a liquid toner feed for feeding a toner to a surface of the recording medium on which an electrostatic image is formed, and a toner recoverer for recovering an excess of toner stuck to the recording medium. The toner recoverer can execute the recovery of an excess of toner not only by suction but also by scraping from the recording medium prior to this suction. Members for eliminating the mixing of foreign matters into the feed side in conjunction with the recovered toner are also provided.

19 Claims, 8 Drawing Sheets

161 (162)

Prior Art

Prior Art

ELECTROSTATIC RECORDER

FIELD OF THE INVENTION

The present invention relates to an electrostatic recorder, arranged to develop an electrostatic latent image formed on a recording medium such as paper, film or cloth by using electrostatic recording heads, and in particular to an electrostatic recorder provided with a system for feeding a liquid toner to develop an electrostatic latent image and recovering an excess of liquid toner.

DESCRIPTION OF BACKGROUND

FIG. 8 shows a general color electrostatic recorder of the single path scheme. With this apparatus, a recording medium 10 wound in a roll is conveyed through four primary color recording sections 104*a* to 104*d,* for example, related to black, cyan, magenta and yellow, at a predetermined speed with the aid of a feed roller 102. When the recording medium passes through individual primary-color recording sections, images of the respective color components for a recording image are recorded and developed, so that a color image is finally obtained only by one-time passage.

On a recording medium conveyed to the first primary recording section 104*a,* first, an electrostatic latent image for an image of corresponding color component is formed by using the electrostatic recording head 106*a.*Next, by a counterclockwise rotating toner roller 108*a,* a liquid toner of corresponding color is lifted while sticking to a spiral groove (not shown) formed on the surface of the toner roll and applied to a record face of the recording medium 10. The liquid toner includes toner particles charged at the reverse polarity to that of the electrostatic latent image made to be dispersed in a suitable organic solvent. Accordingly, the toner particles sticking to the formed region of the electrostatic latent image is combined with the electrostatic latent image on the recording medium and thus the image is developed.

Then, in a suction device 109*a,* an unnecessary liquid toner sticking to the underside surface of the recording medium is removed. The suction device 109*a* includes a groove of U-shaped section and an outer vacuum pump connected through a tube to the bottom of the groove which, sucks an excess of liquid toner sticking to the recording medium by making the interior of the groove a negative pressure with the vacuum pump and sends it to a liquid toner recycling device. Then, by a blast from the underside of the recording medium with a blower 110*a,* the recording medium wet with the solvent of a liquid toner is dried and the procedure proceeds to the recording in the next primary-color recording section. And, at the stage after the passage of all primary-color recording sections, a color image is obtained.

The system of an electrostatic recorder in which such operations of the formation of electrostatic latent images to the removal of unnecessary liquid toner are carried out in a single path from the primary-color recording sections 104*a* to 104*d* is referred to as a single path scheme.

Meanwhile, with the single path scheme, the primary-color recording sections are continuously placed and when the recording medium passes through one primary-color recording section, recording in the next primary-color recording section is performed immediately. Accordingly, if removal of an excess of liquid toner stuck in the preceding recording and its solvent is insufficient, the relevant toner is mixed with the color toner for the preceding stage or the next color toner blots into the preceding-stage solvent in the recording at the next stage, thereby deteriorating the image quality. For this reason, for a sufficient removal and drying of an excess of liquid toner, it is required to slow down the conveyance of the recording medium in a certain degree. Since a large quantity of liquid toner is applied to the recording medium by using a toner roller, the interior of the groove in the suction section is filled with liquid toner and liquid toner jams between the recording medium and the top of the groove with which it makes sliding contact, thereby leaving no room for air to be sucked in. Consequently, an excessive suction force of a vacuum pump accompanies a problem of the recording medium itself to be sucked into the interior of the groove and the suction force is forced to be restricted to some extent. Thus, to remove a liquid toner or its solvent completely, the conveying speed of a recording medium had to be suppressed below a certain rate, which hindered an improvement in recording speed.

In addition, with such an electrostatic recorder as mentioned above, an electrostatic latent image is formed by allowing a discharge to occur between the electrodes corresponding to individual pixels of the electrostatic recording head with a backrest pressed from above, the recording medium and the record face kept in sliding contact with the head surface under a suitable pressure. On the surface of the recording medium, minute spacers for forming a suitable discharge gap between the record face and the electrostatic recording head is provided. To the recording medium having passed by the electrostatic recording head, a liquid toner including toner particles dispersed in a predetermined solvent is applied with the aid of a toner roller. The liquid toner includes charged minute toner particles at the reverse polarity to that of electrostatic latent image dispersed in a predetermined solvent. When the liquid toner is applied to the recording medium, these particles are attracted to the electrostatic latent image formed on the recording medium by an electrostatic force and combined with the surface layer of the recording medium, so that the electrostatic latent image is developed.

The toner roller applies a liquid toner over the whole record face of the recording medium to feed a sufficient amount of toner, but a part of the fed toner is actually submitted to the development of the electrostatic latent image. An excess of applied toner dropped off from the surface of the recording medium or sucked with a suction device to be returned to a toner tank and is admitted to the recycling.

At this time, because the recording medium comes into sliding contact with many machine elements such as the electrostatic recording head and toner roller, some amount of spacer peels off every time of sliding contact occurs and is mixed into the liquid toner to be recovered.

In this way, a liquid toner recycled many times deteriorates in quality by the mixing of other-color toner and spacer. Accordingly, the liquid toner having experienced a fixed number cycles is replaced with a new liquid toner as a whole tank. The period of time from the mounting of a new tank to the need for replacement is substantially proportional to the length of a used recording medium if the type of recorded images is general. On the side of a maker, the amount of recording medium used until the replacement of a liquid toner becomes necessary is determined in advance for the convenience of replacement of a liquid-toner tank.

Meanwhile, the demand for a continuous recording of color images in a much longer recording medium by using an electrostatic recorder other than conventional ones has recently become stronger. However, since the amount of images that can be recorded without replacement of a liquid toner tank is restricted in a conventional electrostatic recorder, there was a problem that the apparatus is compelled to be stopped halfway during the recording for the replacement of a toner tank in a continuous recording of color images on a long recording medium, the operation is interrupted and the efficiency lowers.

Furthermore, in the above electrostatic recorder, the principle of electrostatic recording in an electrostatic recorder of the single path scheme is described below as shown in FIG. 9. The recording medium 10 is conveyed in the arrow direction indicated. On the underside of the recording medium 10, there is provided a recording section 80 comprising electrostatic recording heads 82*a* to 82*d* comprising many electrodes arranged along the width direction of the recording medium 10, the respective liquid toner feed sections 83*a* to 83*d* disposed on the directly downstream side of the individual electrostatic recording heads and further the respective suction sections 84*a* to 84*d* disposed on the downstream sides thereof for the primary colors of black, cyan, magenta and yellow. When the recording medium 10 passes the recording section 80 while making sliding contact with the top of the electrostatic recording heads 82*a* to 82*d,* electrostatic latent images are formed with the electrostatic recording heads 82*a* to 82*d,* a liquid toner is applied from the liquid toner feed sections 83*a* to 83*d* to the recording medium 10 on the directly downstream sides thereof, a liquid toner is stuck to the formed portions of electrostatic latent images on the recording medium 10 and an excess of liquid toner is sucked in with the suction devices 84*a* to 84*d* on the directly downstream sides thereof. By repeating this procedure for the primary colors of black, cyan, magenta and yellow, a color image is printed on the recording medium 10.

As shown in FIG. 10, the electrostatic recorder so arranged as mentioned above also comprises a conventional piping system for feeding a liquid toner to a liquid toner feed section and for recovering an excess of liquid toner by using a suction device. Incidentally, the piping system shown here is a piping system only for one color out of the aforesaid four primary colors of black, cyan, magenta and yellow (here, chosen as black), four systems of such piping are provided in the electrostatic recorder mentioned above.

From the toner bottle 91 filled with a liquid toner, a liquid toner is sucked by means of a pump 92 and the liquid toner delivered from this pump is fed through a Y-shaped junction 93 to a liquid toner feed section 83*a* on one hand and applied to the recording medium 10. Alternatively, the other liquid toner passing through the joint 93 is exhausted through an aspirator 94. The exhausted liquid toner is returned to the toner bottle 91 again. When the liquid toner passes the aspirator 94, a negative pressure is generated inside a suction device 84*a* and the route leading thereto, and the liquid toner 95 applied in excess on the recording medium 10 is sucked in the suction device 84*a*. The liquid toner recovered in this manner is exhausted together with the liquid toner delivered from the pump 92 and passing through the aspirator 94. Midway in the piping leading from the suction device 84*a* to the aspirator 94, a vacuum switch 96 is provided. The level of a negative pressure is monitored with the vacuum switch 96 and, when the suction device 84*a* cannot exhibit its function sufficiently, for example, due to the presence of folds or creases, the conveyance of the recording medium 10 is stopped to prevent an excess of liquid toner 95 from being delivered without sucked in the suction device 84*a* while kept stuck to the recording medium 10.

With the piping system so arranged as mentioned above, a much greater amount, e.g., double or more, of liquid toner needs to flow through the aspirator 94 than the amount required for the printing itself because the liquid toner needs to be let to flow through the aspirator 94. For this reason, a large size of pump 92 becomes necessary, so that the installation space of a pump increases and the price becomes also high.

In addition, there is a limit for the installation of a large-sized pump 92 or a large-capacity aspirator 94. Thus, only the presence of slight folds or creases would make it impossible to suck an excess of liquid toner on the recording medium 10 and it takes time till the suction becomes possible again, so that there is a problem that a stained image is printed on the recording medium 10 in the end.

SUMMARY OF THE INVENTION

The present invention is made with the above problems of the background art in mind, and it is an object of the present invention to provide an electrostatic recorder enabling the recording speed to be raised while keeping a high color image quality.

Also, another object of the present invention is to provide an electrostatic recorder having a liquid toner feed system enabling plenty of images to be recorded at the one-time replacement of a liquid toner tank.

And, still another object of the present invention lies in providing an electrostatic recorder having a gear pump capable of fulfilling the feed of a liquid toner and the recovery of unnecessary toner at one unit without need for an aspirator and without mixing air into a liquid toner.

To attain the above objects, the electrostatic recorder according to an embodiment of the present invention is an electrostatic recorder comprising, electrostatic latent image recording means for forming an electrostatic latent image on a recording medium conveyed at a predetermined speed, toner feed means for feeding a toner to a surface of the recording medium on which a latent image is formed, and toner recovery means for recovering an excess of toner stuck to the recording medium, wherein the toner recovery means can execute the recovery of an excess of toner not only by suction but also by scraping from the recording medium prior to this suction, and the toner recovery means provided with means for eliminating the mixing of foreign matters into the feed side in conjunction with the recovered toner.

In this electrostatic recorder, the toner recovery means includes toner removal means, provided between the toner feed means and suction means for performing the recovery of an excess of toner by suction, for scraping off an excess of toner from the recording medium.

Also, the aforesaid toner is a liquid toner, the recovery means includes a feed route for the liquid toner, a recovery route and a toner reservoir of a large capacity, and the toner feed route communicates with the top of the toner reservoir and the toner feed route with the bottom thereof.

And, the toner feed route and the toner recovery route are connected to a gear pump including a pair of gears and a gear pump including a pair of gears formed inside one of the gears, respectively so as to perform the feed and recovery of toner.

In addition, to attain the above object, an electrostatic recorder according to an embodiment of the present invention comprises, electrostatic latent image recording means for forming an electrostatic latent image on a recording medium conveyed at a predetermined speed, toner feed means for feeding a liquid toner to a surface of the recording medium on which an electrostatic latent image is formed;

suction means for an unnecessary liquid toner from the recording medium to which a liquid toner sticks, and liquid toner removal means provided between the toner feed means and the suction means for scraping a liquid toner while kept in sliding contact with the record face of the recording medium conveyed, wherein the liquid toner removal means removes the greater part of unnecessary liquid toner in advance before the recording medium reaches said suction means.

In this electrostatic recorder, the liquid toner removal means includes a rod-shaped member of nearly circular section.

With such an electrostatic recorder, since the greater part of unnecessary liquid toner in the recording medium, to which a liquid toner is applied by toner feed means, is scraped off, the interior of the suction means is filled with no liquid toner and air is sucked inside through the contact portion of the recording medium and the suction means by making a negative pressure through suction. Consequently, since the recording medium itself is not sucked in and the suction force can be considerably elevated, drying of the recording medium is greatly accelerated. Thus, even if the conveyance speed of the recording medium is raised, a high color image quality can be maintained. In addition, since the liquid toner removal means may contain, for example, a rod-shaped member of nearly circular section, a sufficient effect can be taken even in a simple structure.

In an electrostatic recorder to attain the other object mentioned above, a liquid toner feed system in the electrostatic recorder for feeding a liquid toner to the development section for applying a liquid toner to a surface of the recording medium on which an electrostatic latent image is formed to develop the electrostatic latent image has a large-volume liquid toner reservoir comprising a toner feed route and a toner recovery route, separated from the main electrostatic recorder body, the liquid toner recovery route is so arranged as to communicate with the top of the recovery means and moreover the front end of the toner feed route is so arranged so as to be situated near the bottom of the recovery means.

And, the electrostatic recorder further includes a liquid toner feed system for feeding a liquid toner to the development section for applying a liquid toner to a surface of the recording medium on which an electrostatic latent image is formed to develop the electrostatic latent image, comprising: an internal reservoir provided inside the main body of the electrostatic recorder, equipped with a first toner feed route for feeding a liquid toner to the development means and a first toner recovery route for recovering the liquid toner after the development; and an external reservoir provided outside the main body of the electrostatic recorder, equipped with a second toner feed route for feeding a liquid toner to the internal reservoir and a second toner recovery route for returning the liquid toner recovered from the internal reservoir wherein the second toner recovery route is so arranged as to communicate with the top of the external reservoir and moreover the front end of the toner feed route is so arranged so as to be situated near the bottom of the external reservoirs.

Such a liquid toner feed system further includes, an intra-reservoir reservoir disposed inside the internal reservoir and communicating with the internal reservoir through an overflow exhaust port, wherein the first toner feed route is made to communicate with the interior of the intra-reservoir reservoir and the second toner feed route is made to communicate with the intra-reservoir reservoir, the liquid toner in the intra-reservoir reservoir is made into an overflow state and is fed through the external reservoir, the second toner feed route, the intra-reservoir reservoir and the first toner feed route to the development means and the liquid toner after use is recovered through the first toner recovery route, the internal reservoir and the second toner recovery route to the external reservoir.

In addition, a float sensor is provided in the internal reservoir and the liquid surface level of a liquid toner in the internal reservoir is maintained at a nearly constant level by controlling the feed amount of a liquid toner through the second toner feeder route and the recovery amount of a liquid toner through the second toner recovery route.

With an electrostatic recorder equipped with such a liquid toner feed system, by the provision of a large-volume liquid toner reservoir separated from the main body of the electrostatic recorder, the increasing rate of impurities per unit time can be suppressed, the period of time till the liquid toner is so deteriorated as to need replacement is prolonged and the replacement cycle of liquid toner or supply cycle of condensed toner becomes longer. Also, by sucking up a liquid toner from near the bottom of the liquid toner reservoir to feed it to the development section, the suction of air bubbles apt to be generated near the surface in the liquid toner reservoir can be prevented and the deterioration of print image quality originating from air bubbles can be prevented.

In addition, by a separate provision of an internal reservoir and an external reservoir according to the above arrangement, when the requirement for prolonging the replacement cycle of liquid toner or supply cycle of condensed toner becomes high, the addition of an external reservoir alone afterward becomes applicable and the selection of a user becomes wider and a waste-free investment of equipment becomes possible. Also, by sucking up a liquid toner from near the bottom of the external reservoir, the suction of air bubbles likely to be generated near the surface in the liquid toner reservoir can be prevented and the deterioration of print image quality originating from air bubbles can be prevented.

Furthermore, by having an intra-reservoir reservoir provided further inside the internal reservoir and making the liquid toner sucked from the external reservoir, passing through the internal reservoir and fed to the development into an overflow state according to the present invention, the suction of air bubbles likely to be generated near the surface in the liquid toner reservoir can be prevented and the deterioration of print image quality originating from air bubbles can be prevented.

And, by the provision of a float sensor in the internal reservoir and by controlling the feed amount of a liquid toner through the second toner feeder route and the recovery amount of a liquid toner through the second toner recovery route on the basis of the signal thereof according to the above arrangement, the liquid surface level of liquid toner in the intra-reservoir reservoir is maintained nearly constant.

To attain still another object, a gear pump for the electrostatic recorder, comprising, first and second gears having their outer teeth engaged with each other and a third gear so arranged so that its outer teeth are engaged with the inner teeth of the second gear, is characterized in that a first suction path and a first discharge path are provided on one side and on the other side relative to the engaged portion of both teeth outside the first and second gears and moreover a second suction path and a second discharge path are provided on one side and on the other side relative to the engaged portion of both teeth inside the second gear and outside the third gear and that a first fluid is pumped through the first suction path and the first discharge path by a rotation of the first to third gears in a predetermined direction and a second fluid is pumped through the second suction path and the second discharge path by a rotation of the first to third gears.

The gear pump mentioned above is characterized in being actuated by a rotational drive of the first gear.

Also, such a gear pump is characterized in that teeth are provided on the inner periphery of the first gear, a fourth gear to engage with teeth on the inner periphery of the first gear is provided inside the first gear and the first gear is rotationally driven through the fourth gear.

And, such a gear pump is actuated by a rotational drive of the third gear.

With a gear pump according to the above arrangement, the contact region of outer teeth of the first and second gears (referred to as first region) and the contact region of inner teeth of the second gear and outer teeth of the third gear (referred to as second region) are completely separated as outside and inside the second gear. Accordingly, the pumping route leading from the first suction to the first discharge route provided in the first region and the pumping route leading from the second suction to the second discharge route provided in the second region are completely independent and the fluids passing through these routs are not mixed with each other.

In addition, since the first and second gears and the second and third gears are mutually engaged respectively, rotation of the first gear will cause the rotation of the third gear and rotation of the third gear will cause the rotation of the first gear, where the first and third gears are common in that only outer teeth thereof are gearing with the second gear. Thus, by rotationally driving either the first gear or the third gear, the gear pump can be actuated.

DETAILED DESCRIPTION OF THE INVENTION

Figure 1:
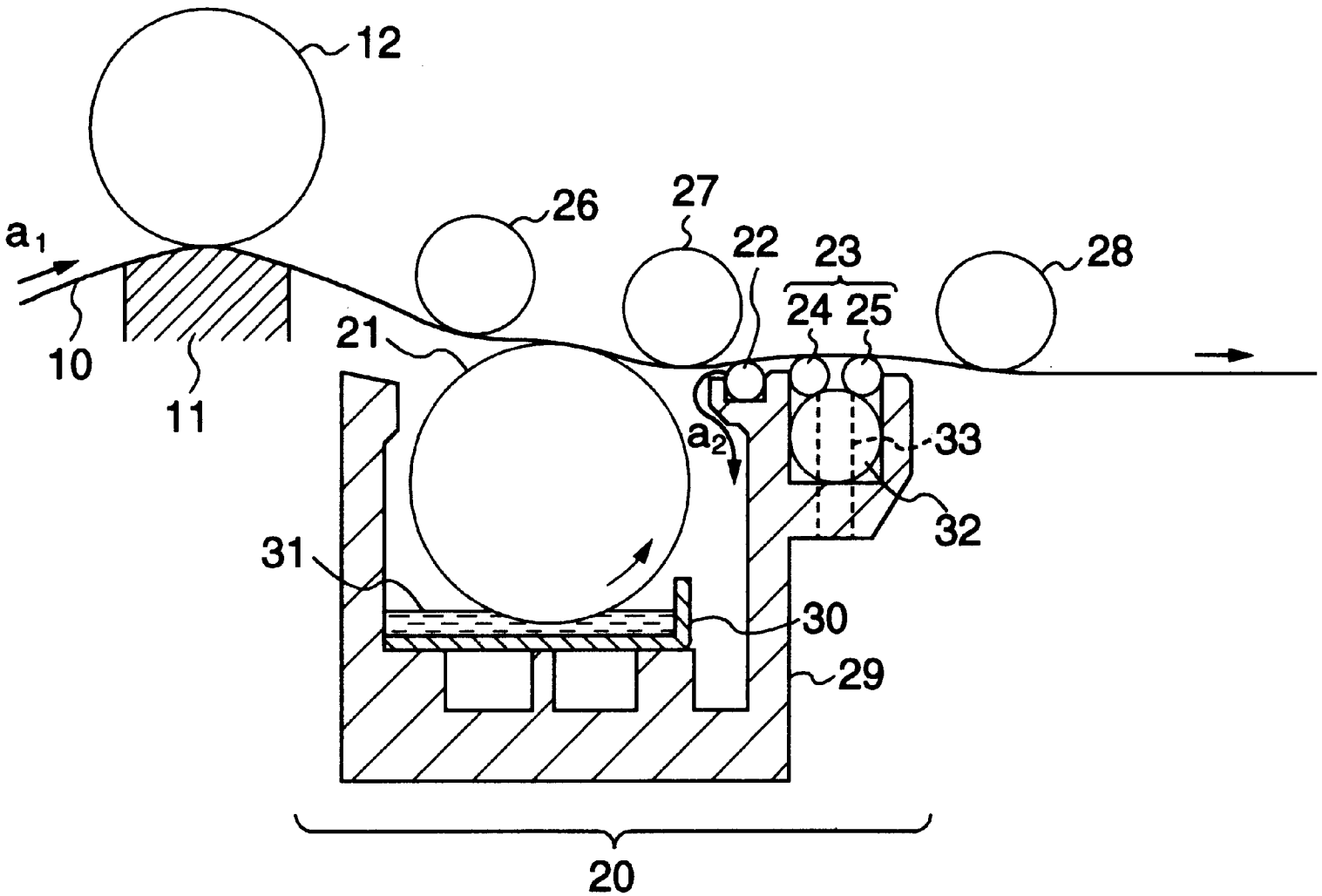
FIG. 1 is a schematic sectional view of the section for the recording of an image for one color in a color electrostatic recorder of the single path scheme according to the present invention.

Hereinafter, an embodiment of the present invention will be described referring to the drawings. FIG. 1 is a sectional view showing the outline of a section for conducting an image recording for one color in a color electrostatic recorder of the single path scheme. With an actual color electrostatic recorder of the single path scheme, for example, four of image recording sections similar to that of FIG. 1 are provided for individual colors. In FIG. 1, a recording medium 10 on which an image is formed is conveyed in the direction of the arrow $a_1$ of FIG. 1 (subscanning direction) while a back tension is applied. The electrostatic recording head 11 serves to form an electrostatic latent image on the recording medium 10 sliding thereon and is driven in accordance with an image signal fed from a predetermined signal processing circuit. A press roller 12, pad roller for a backrest, presses the recording medium 10 to the side of the electrostatic recording head 11 and brings the recording medium into sliding contact with the electrode part of the electrostatic recording head 11 under a suitable pressure. On the record face (underside of FIG. 1) of the recording medium 10, spacers comprising silica particles on the order of 5 to 30 $\mu$m in diameter is dispersed at a suitable density. By these spacers, a discharge gap is produced between the electrostatic recording head and the dielectric layer of the recording medium, the recording medium is charged by a discharge between the recording medium and the recording head, and an electrostatic latent image is formed.

The recording medium 10 passing through the electrostatic recording head 11 is sent to a development section 20. In the development section 20, press rollers 26, 27, 28 for bringing the recording medium 10 into sliding contact with a toner roller 21, a scraper 22 and guide bars 24, 25 of the suction section 23 are provided on the upside of the recording medium 10. The scraper 22, the guide bars 24, 25 and a support member for the guide bars are all made of stainless steel rod-shaped members which are detachably fixed to a case member 29 containing the toner roller 21 with the aide of a fixing member (not shown). These parts with which the recording medium are always in sliding contact and have a high requiring frequency of replacement, but the above arrangement enables only the necessary parts to be replaced while the case member is left as it is after the fixing member is detached when replacement is required. Accordingly, in contrast to a conventional recorder in which these parts and the case are arranged in a one-piece unit, the replacement operation of parts becomes easy and simple, and the operator's burden is reduced.

With color electrostatic recorder of the single path scheme, such electrostatic recording heads and development sections are provided in series, for example, as four stages and finally a color image is obtained by conducting a recording for the respective primary colors at individual stages.

A toner feed tray 30 situated below the toner roller 21 is filled with a liquid toner 31 comprising toner particles diffused into a predetermined solvent to the level slightly beyond the lower end of the toner roller 21. This liquid toner is sent from the toner bottle mentioned below through a predetermined route to the toner feed tray 30 by a gear pump 150. Toner particles in the liquid toner are charged in the opposite polarity to that of an electrostatic latent image. When the toner roller 21 is rotated counterclockwise, the liquid toner 31 is lifted along the groove on the surface of the toner roller 21 and applied to the under face of the recording medium 10 at the portion contacting the recording medium 10 in the toner roller 21. Toner particles in the liquid toner, sticking to the portion in which the electrostatic latent image is formed, are drawn to the electrostatic latent image formed on the recording medium by the electrostatic force and combined with the surface layer of the recording medium in a formed proportion of the electrostatic latent image and the electrostatic latent image is developed.

If another-color image is recorded with the solvent of the liquid toner remaining on the recording medium 10 after one-color image is recorded, the color image quality deteriorates. For this reason, the toner remaining on the recording medium is removed after the development and further the solvent is dried with the aid of a blower device installed downstream the development section. With this embodiment, to remove the greater part of unnecessary liquid toner prior to drying with the blower device, the scraper 22 and suction section 23 are provided at the following step of the toner roller 21.

The scraper 22 is made of a stainless steel rod-shaped member a little longer than the width of the recording medium 10 and the section is a circle of about 5 mm diameter. The shaft of a scraper 22 is fixed at the case member 29 so as to cross the progressing direction of the recording medium at right angles.

The scraper 22 scrapes off the greater part of unnecessary liquid toner remaining on the recording medium by the sliding of the recording medium 10 thereon. The scraped off liquid toner drops off along the inner wall of the case member as indicated with the arrow $a_2$. On the other hand, the suction section 23 creates a negative pressure in the space between the guide bars 24 and 25 below the recording medium 10 with the aide of a pump (not shown) connected through the suction path 33 to suck the liquid toner remaining on the recording medium. The scraper 22 is made of a stainless steel rod-shaped member because of taking it into consideration that the corner parts that might damage the recording medium coming into sliding contact therewith are eliminated, the linearity of the portion making contact with the recording medium can be easily provided in manufacturing and a sufficient wear resistance is observed. Thus, if these conditions are satisfied, any material other than a stainless steel rod-shaped member may be employed as the scraper.

With a conventional recorder equipped with no scraper, it is required to remove the liquid toner only in the suction section, but since the recording medium is conveyed to the suction section with an excess of liquid tones stuck thereto, the space formed with a spacer between the recording medium and the guide bars is filled with the liquid toner. For this reason, it was required to restrict the suction force in some degree so that the recording medium itself comes to be sucked, to slow down the conveyance of the recording medium in consideration for this restriction and to remove the liquid toner. Furthermore, it became necessary to dry the remaining solvent by means of a blower device at the next stage. This creates a hindrance in promoting the recording speed.

In contrast to this, with this embodiment, since the greater part of liquid toner is scraped off in advance by the scraper 22 provided in front of the suction section 23, the amount of liquid toner to be sucked in the suction section 23 greatly decreases. In advance, since the greater part of liquid toner is scraped off by the scraper 22, a sufficient gap is produced by a spacer between the recording medium 10 and the guide bars 24, 25 and air is sucked through this gap, so that the suction force of the suction section 23 can be made stronger than in conventional devices. Through the pressure of water head 600 mm $H_2O$ was a conventional limit, the limit of suction pressure could be elevated to water head 1500 mm $H_2O$ in this embodiment.

From these improvements, the time taken for the removal of liquid toner is greatly shortened. In addition, since drying of a solvent is accelerated by the air sucked in through the gap between the recording medium 10 and the guide bars 24, 25, the drying time in the blower device at the next stage is also shortened. In consequence, the conveyance of a recording medium can be further speeded up. And, since the solvent remaining in the recording medium is almost completely dried by the sucked air, the deterioration of image quality due to the mixing with the toner at this stage can be prevented. Furthermore, even if a floating of the recording medium 10 occurs due to a small degree of folding, breaking or creasing, the recording medium 10 can be firmly brought into close contact with the guide bars 24, 25 by intensifying the suction force of the suction section 23. Thus, in contrast to a conventional recorder in which it was required to stop the recorder every time when a slight fold or the like occurred, the operating efficiency is promoted.

Next, referring to FIG. 7, the replacement operation of a electrostatic recording head 11 will be described. On the electrostatic recording head 11, electrostatic recording electrodes and auxiliary electrodes are embedded, for example, at a density of 400 dpi over a length nearly equal to the width of the recording medium in the main scanning direction into an dielectric material such as epoxy resin and formed. In addition, under the electrostatic recording head 11, numbers of integrated circuits for driving the electrodes and other circuit parts are packaged. Accordingly, in a large-sized electrostatic recorder for a 36 inch wide or wider recording medium, the weight of the electrostatic recording head 11 amounts to several tens of kg. When replacing an electrostatic recording head in a conventional recorder, the lower end of the head had to be lifted to the upper end of the side wall of the main body to demount the head from inside the recorder after opening or removing the top cover. For this reason, the replacement operation of an electrostatic recording head was difficult to conduct for oneself and required the cooperation of two or more persons in principle.

Figure 7:
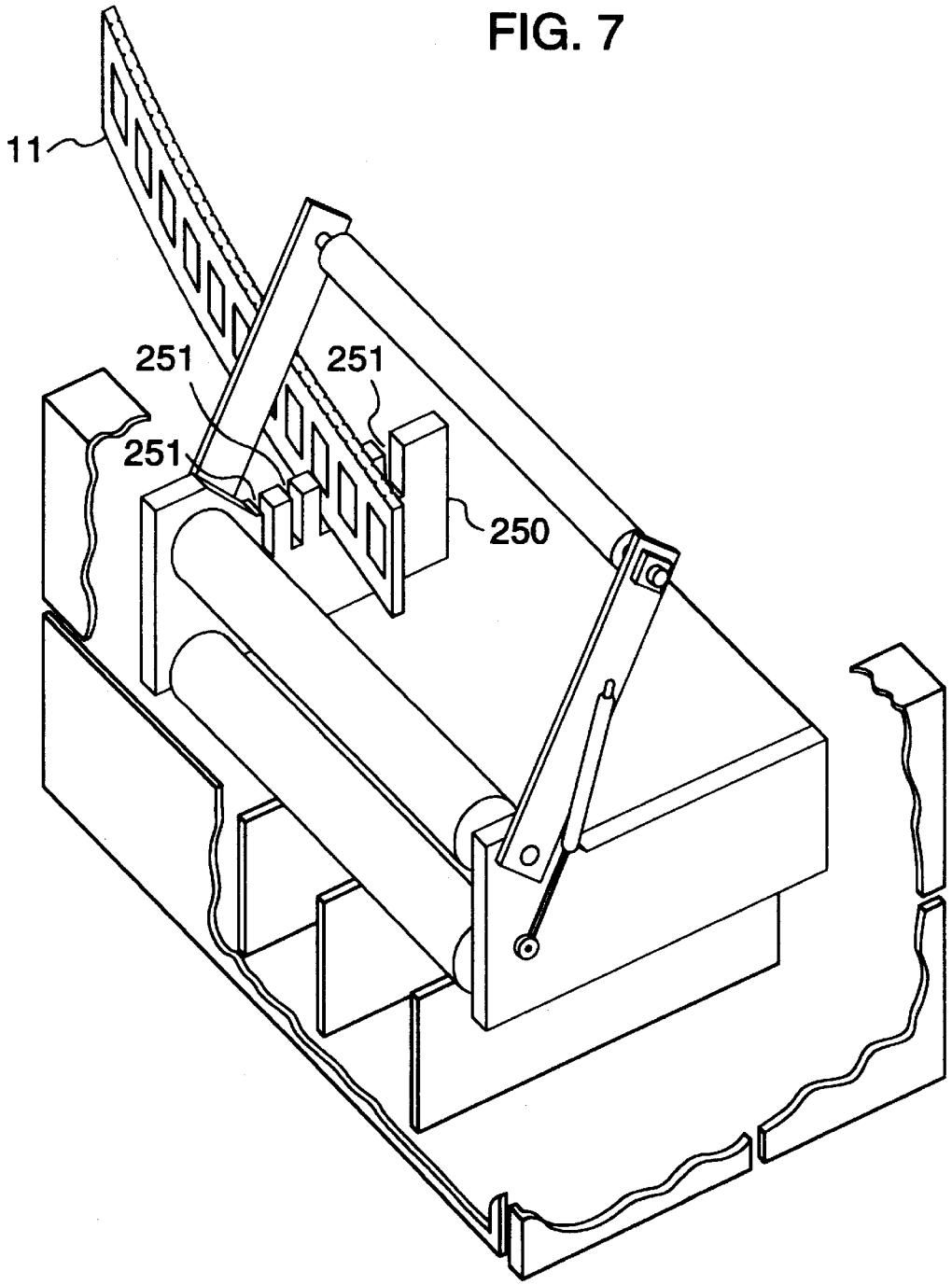
FIG. 7 is a schematic perspective and partly cutaway view illustrating the replacement operation of an electrostatic recording head in an electrostatic recorder according to the present invention.
Figure 9:
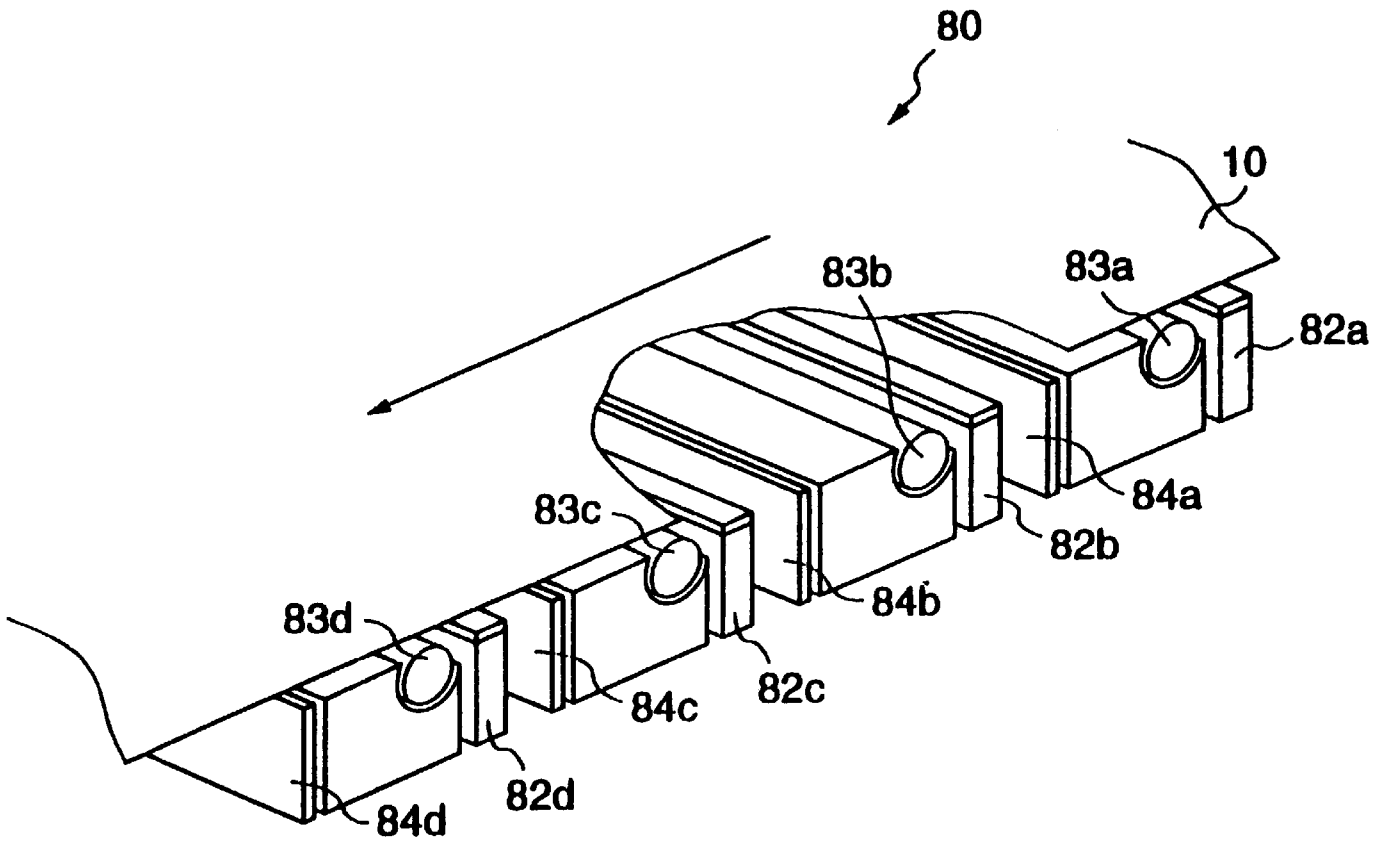
FIG. 9 Prior Art
FIG. 9 is a schematic perspective view for illustrating the principle of electrostatic recording in an electrostatic recorder.
Figure 10:
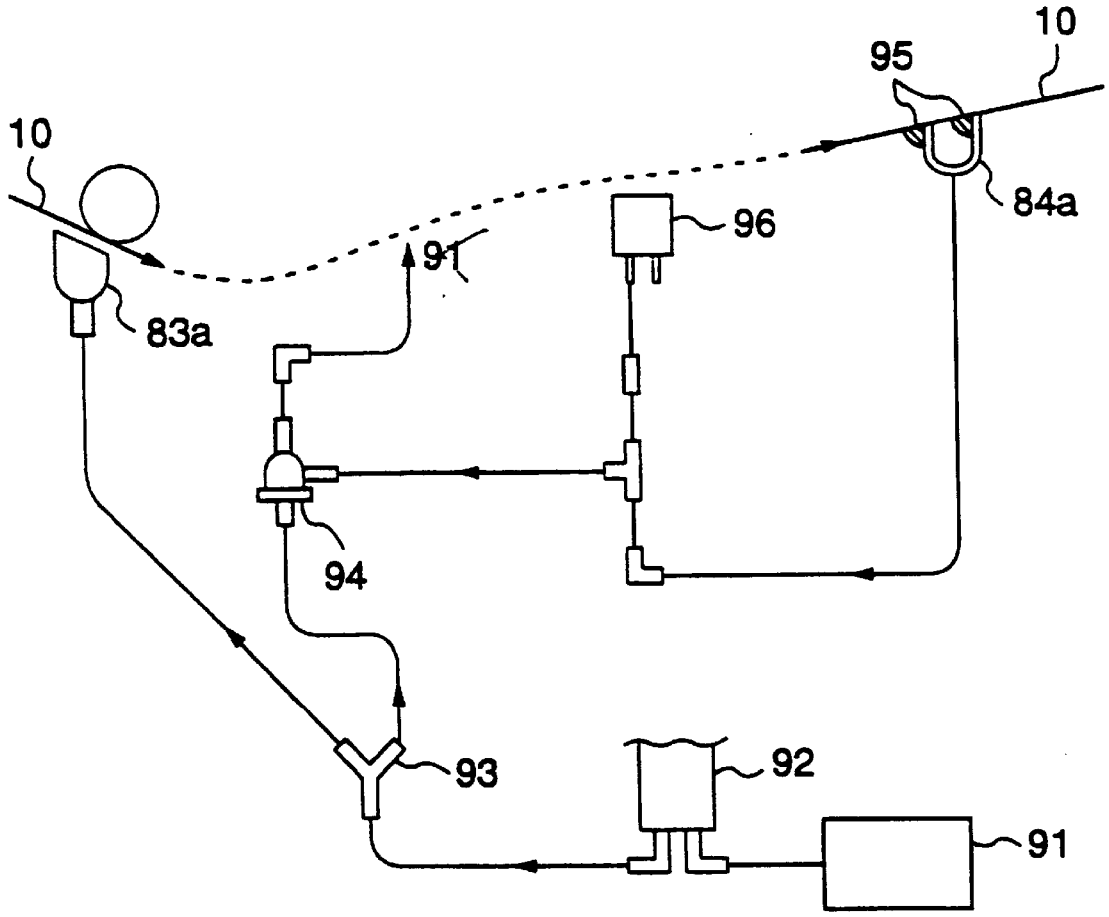
FIG. 10 is a piping diagram showing one example of piping system for feeding a liquid toner and recovering an excess of liquid toner in an electrostatic recorder.

In contrast to this, with this embodiment of electrostatic recorder, cutaway portions 251 equal in number to the electrostatic recording heads 11 are provided in the side wall 250 on one side of the main body as shown in FIG. 7.

Incidentally, for simplicity, only one of the electrostatic recording heads 11 is shown in FIG. 7. Each cutaway portion 251 is provided directly above the exactly lateral side of such a portion as to install the corresponding electrostatic recording head 11. Accordingly, when replacing an electrostatic recording head 11, first, one side (side with the cutaway 251) of the electrostatic recording head 11 to be replaced is lifted and put onto the corresponding cutaway portion 251. At this time, on the other side of the electrostatic recording head 11, a roller provided at the bottom gets on a rail (not shown) provided at the corresponding position of the bottom of the electrostatic recording head 11 and the recording head becomes simply movable. By drawing out the lifted side toward outside the main body of the recorder from this state as shown in FIG. 7, the electrostatic recording head 11 can be taken out outside the electrostatic recorder.

The lifting weight of one side of the electrostatic recording head 11 becomes about a half of the weight of the electrostatic recording head 11. Besides this, the vertical distance to be lifted is significantly shorter than the height of the electrostatic recording head 11. Consequently, the labor required for the replacement operation is reduced and it becomes sufficiently possible even for a single operator to replace the electrostatic recording head 11.

The present invention is not limited to the embodiment mentioned above, but may be subjected to various modifications and variations within its scope.

As described above, according to the present invention, since the greater part of an unnecessary liquid toner is scraped off by toner removal means before the recording medium reaches the suction means, the interior of the suction means is not filled with a liquid toner and by making a negative pressure through the suction, air is sucked from the contact portion of the recording medium and suction means to the interior. In this way, since the recording medium itself is not sucked and the suction force of the suction means can be elevated to a considerable extent, drying of the recording medium is greatly accelerated, thereby making it possible to provide an electrostatic recorder that can maintain a high image quality even if the conveyance of the recording medium is speeded up.

Figure 2:
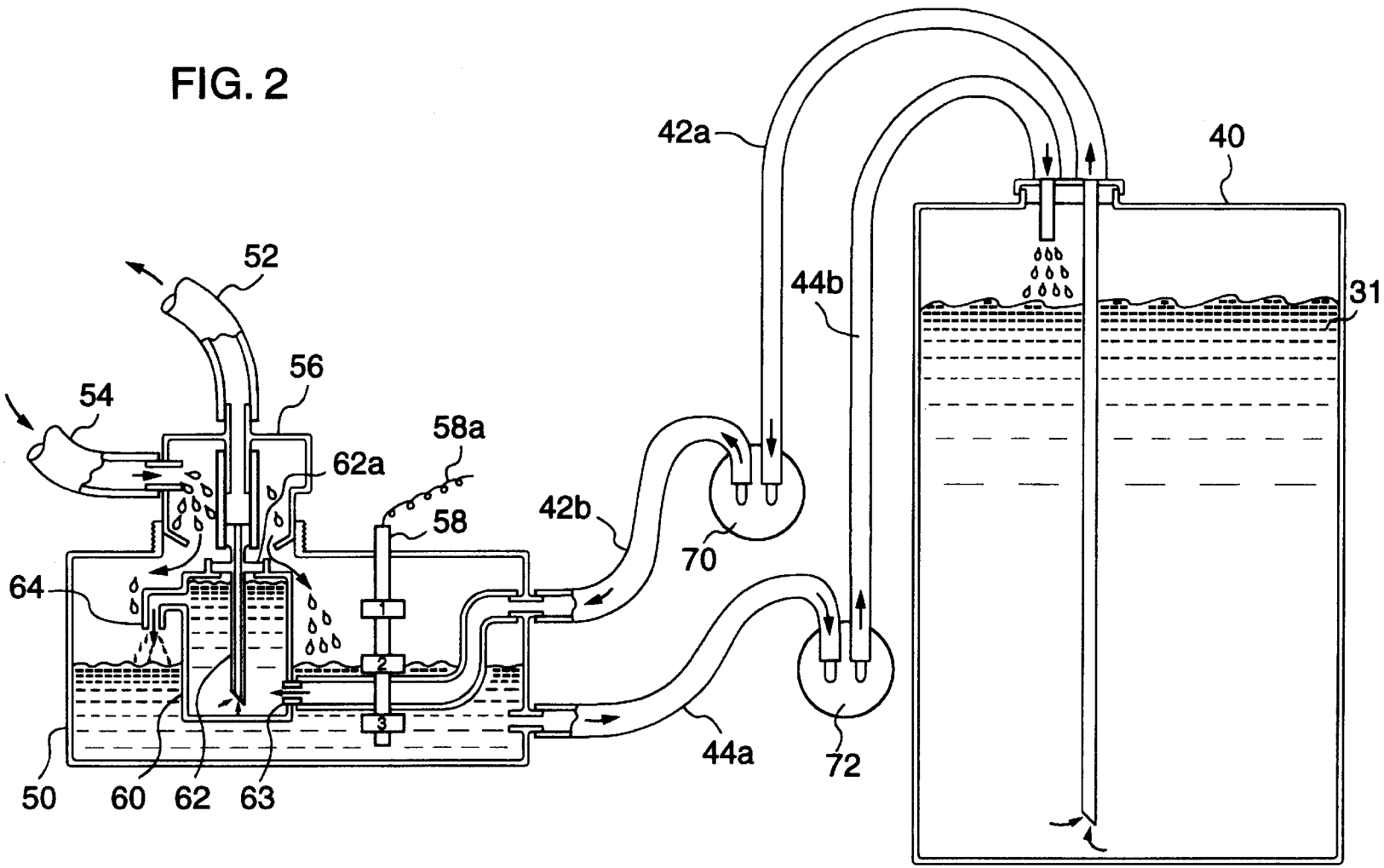
FIG. 2 is a schematic illustration of liquid toner feed means not only for feeding a liquid toner for development but also for recovering an excess of liquid toner after the development in an electrostatic recorder according to the present invention.

Alternatively, as clear from referring to FIG. 2, another embodiment of the present invention is a liquid toner feed system for feeding a development liquid toner to the toner feed tray 30 and for recovering the excessive liquid toner scraped off with the scraper 22 or sucked in the suction section 23 after the use. This system comprises a large-volume external bottle 40 provided outside an electrostatic recorder and an internal bottle 50 provided inside the recorder. The cap part 56 is fixed detachably at the top of the internal bottle 50 by fit in the opening. A feed pipe 52, a first toner feed pipe according to the present invention, and a recovery pipe 54, a first toner recovery pipe are linked with the cap part 56, serving to mutually separate the routes of these two pipes. In the internal bottle 50, another small-sized bottle 60 is provided further. This bottle 60 serves as an intra-reservoir reservoir according to the present invention. The bottle 60 is provided with a pipe 62 coupled with the feed pipe 52, a inflow port 63 for a liquid toner and an overflow exhaust port 64. The pipe 62 is provided with a flange-shaped lid 62*a* which hermetically seals the upper opening of the bottle 60.

The liquid toner 31 in the external bottle 40 is sucked up from near the bottom of the external bottle 40 by means of a pump 70 and delivered through pipes 42*a*, 42*b*, a second toner feed route according to the present invention, and a inflow port 63 to the bottle 60 in the internal bottle 50. The liquid toner delivered to the bottle 60 is further sucked up from near the bottom thereof, delivered through the pipe 62 and the feed pipe 52 to the toner feed tray 30 and thereafter applied to the recording medium with the toner roll. At that time, the pump 70 makes the amount of liquid toner fed to the bottle 60 greater than that of liquid toner sucked up through the feed pipe 52 from the bottle 60, thus leading the bottle 60 to an overflow state. Accordingly, there is a state that a liquid toner is always flowing out from the overflow exhaust port 64.

On the other hand, an excess of liquid toner after the development processing is recovered through the recovery pipe 54 to the internal bottle 50, further returned through pipes 44*a*, 44*b*, a second recovery route, to the external bottle 40 by means of a pump 72 and recycled. At this time, in the internal bottle 50, the liquid toner recovered from the recovery pipe 54 and the liquid toner to be fed through the feed pipe 52 to the toner feed tray 30 are not mixed together on account of the structure of the cap part 56 shown in FIG. 2 and the provision of the bottle 60.

In the interior of the internal bottle 50, a float sensor 58 is provided. The normal liquid surface of the internal bottle 50 is at the level indicated with "2" of this sensor and at that time, the pumps 70, 72 are both ON. When the liquid surface rises and reaches the level indicated with "1", the pump 70 becomes OFF and the pump 72 is ON to lower the liquid surface level. On the other hand, when the liquid surface falls and reaches the level indicated with "3", the pump 70 is ON and the pump 72 becomes OFF to raise the liquid surface level. By such operations, the liquid surface level of liquid toner in the internal bottle 50 is maintained nearly constant. Incidentally, numeral 58*a* denotes an output signal line of the float sensor 58 for controlling the switches of individual pumps.

Meanwhile, when air bubbles are mixed in the liquid toner applied to the recording medium by using the toner roller of the development section, no toner is stuck to the recording medium at these bubble portions and therefore an unevenness in the stuck amount of toner occurs at some positions of the recording medium, thus deteriorating the image quality. Since the recovered liquid toner is always returned to the external bottle 40, air bubbles are generated near the liquid surface as a result of splashes or ripples caused by accompanying impacts. Since a certain period of time is taken till the air bubbles generated disappear, air bubbles contained in a large quantity are carried with the toner roller and stuck to the recording medium when the pump 70 sucks up the liquid toner near the liquid surface. However, if the external bottle 40 is chosen at a large volume and a depth of the order of approx. 50 cm, almost all air bubbles have disappeared in the liquid toner near the bottom. Thus, by sucking up the liquid toner 31 from near the bottom of the external bottle 40, the liquid toner can be delivered to the internal bottle 40 without mixing of air bubbles generated near the liquid surface.

In an excess of liquid toner recovered in the recording section of the electrostatic recorder, air bubbles are generated when the liquid toner is removed from the recording medium. In addition, when the recovered liquid toner is returned from the recovery pipe 54 at a considerable power to the internal bottle 50, the liquid surface in the internal bottle 50 is rippled and plenty of air bubbles are also generated here. However, by having a bottle 60 separated from this liquid surface provided in the internal bottle 50 and feeding the liquid toner through this bottle to the toner feed tray 30, the mixing of air bubbles can be prevented which would occur if the liquid toner fed from here through the feed pipe 52 to the toner feed tray 30 is mixed with that recovered and returned from the recovery pipe 54. Since it can be effectively prevented that air bubbles are mixed into the liquid toner fed to the toner feed tray 30, the quality of printed images is improved as compared with a conventional recorder.

Furthermore, by the provision of a large-volume external bottle 40, separate from the internal bottle, the increasing rate of impurities per unit time can be suppressed low. Accordingly, the period of time from the replacement of the external reservoir 40 till the liquid toner becomes so contaminated as to require the next replacement is greatly prolonged and the cycle of liquid toner replacement or condensed toner supply becomes longer. Thus, even when a large number of images are continuously printed, the frequency of stopping a recorder halfway is lowered and the operating efficiency is promoted.

Figure 3:
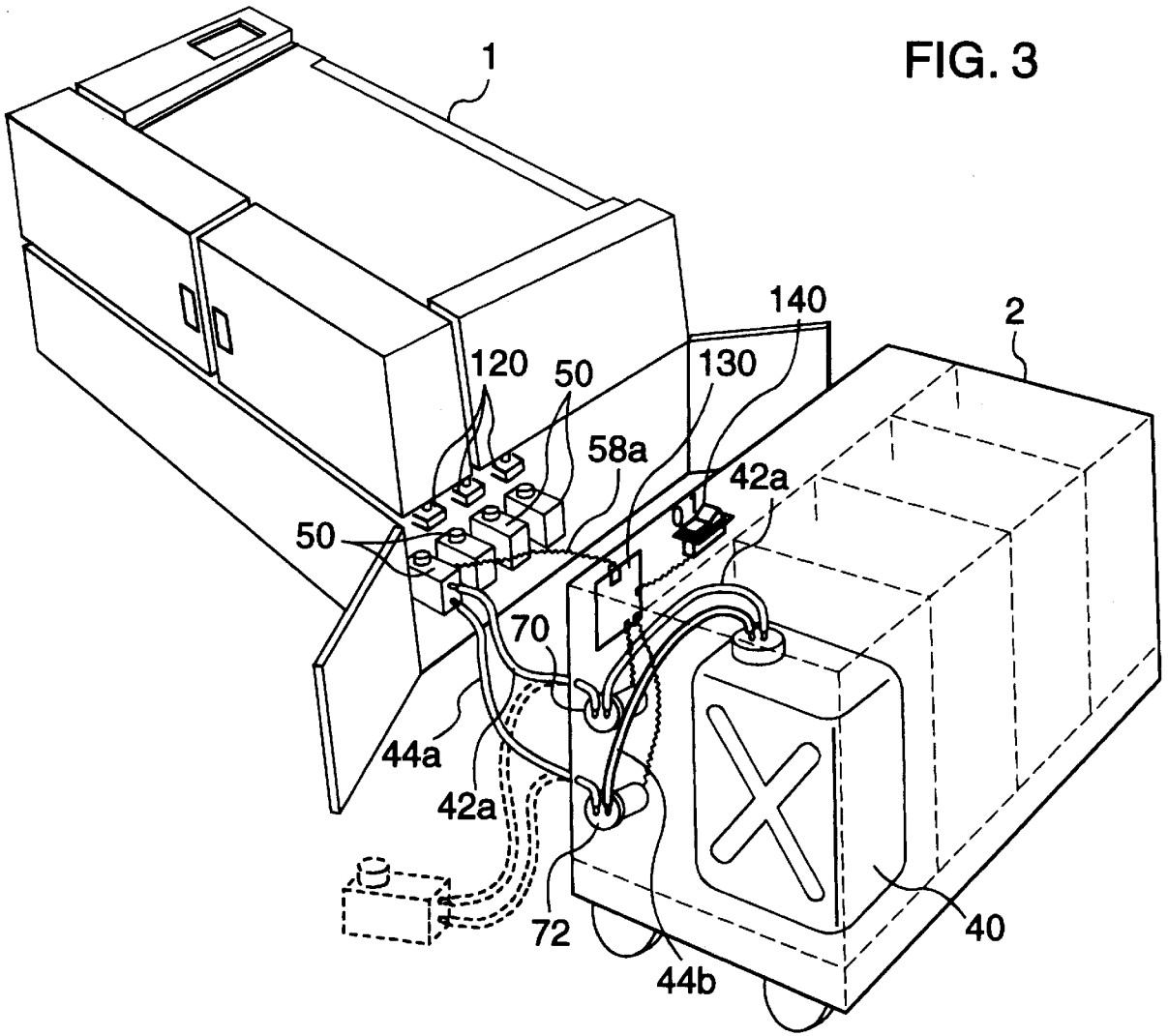
FIG. 3 is a perspective view of the main body of an electrostatic recorder and an external reservoir comprising a plurality of bottles integrated into a single unit.

FIG. 3 is a perspective view showing the main body 1 of an electrostatic recorder and an external bottle unit 2 comprising a plurality of external bottles integrated into a single unit. Incidentally, in FIG. 3, for simplicity, only the external bottle for one color is shown. The external bottle unit 2 is equipped with the respective external bottles for four colors and further each external bottle 40 comprises a feed pump 70, a recovery pump 72, a pump control substrate 130 and a power supply switch 140. In the tank housing section inside the main apparatus body 1, internal bottles 50 for four colors are equally provided. In FIG. 3, small bottles 120 shown behind the internal bottles 50 are reservoirs for a condensed toner and when the concentration of a liquid toner is lowered, the corresponding condensed toner is additionally poured into the relevant internal bottle 50 by means of exclusive-use pump (not shown) according to need. Each internal bottle 50 of the main apparatus body 1 and the corresponding external bottle 40 are mutually connected through a feed pipe 42*a,* a recovery pipe 44*a* and an output signal line of a float sensor 58*a,* but the respective bottles can be installed at different places apart from each other by lengthening these pipes and the signal line.

As indicated with dotted lines in FIG. 3, an internal bottle 50 can be easily taken out of the main apparatus body 1. This internal bottle 50 has a bottle 60 shown in FIG. 2 and is connectable to an external bottle 40, but has the same form and size as with a conventional liquid toner reservoir, that is, a general liquid toner reservoir not containing a bottle 60 and unconnectable to an external bottle 40 or a cap part 56. Accordingly, when a user wants the additional installation of an external bottle unit 2 later, the additional installation becomes possible only by replacing the general liquid toner reservoir used formerly in the apparatus with an internal bottle 50 according to this embodiment. Besides this, by a simple operation, the volume of a bottle is easily increased and an improvement for an electrostatic recorder of a longer bottle replacement cycle becomes possible.

Incidentally, the present invention is not limited to the embodiment mentioned above, but may be subjected to various modifications and variations within its scope.

As described above, according to the present invention, by having a large-volume liquid toner reservoir provided separate from the main body of an electrostatic recorder and sucking up a liquid toner from near the bottom of a liquid toner reservoir to feed the liquid toner to a development section of the electrostatic recorder, the increasing rate of impurities per unit time can be suppressed. Accordingly, the period of time from the replacement of the liquid toner reservoir till the liquid toner becomes so contaminated as to require the next replacement is greatly prolonged and the cycle of liquid toner replacement or condensed toner supply becomes longer. Thus, it is possible to provide a liquid toner feed system for an electrostatic recorder in which, even when plenty of images are continuously printed, the frequency of stopping a recorder halfway is lowered and the operating efficiency is promoted.

Also, according to the present invention, it is possible to provide a liquid toner feed system for an electrostatic recorder in which, not only by having an internal reservoir provided inside the main body of an electrostatic recorder but also by having a large-volume liquid toner reservoir provided separate from the main body of the electrostatic recorder and making it into an overflow state as to feed a liquid toner from the external reservoir through an intra-reservoir reservoir in the internal reservoir to the development, the liquid toner fed to the development and the liquid toner recovered and returned after the development are completely separated, so that no air bubbles contained in the liquid toner after the recovery is mixed into the liquid toner to be fed to the development. Further by sucking up the liquid toner from near the bottom of the external reservoir with hardly any air bubbles generated, the deterioration of print image quality originating from air bubbles is effectively prevented and a high print image quality is obtained.

Figure 4:
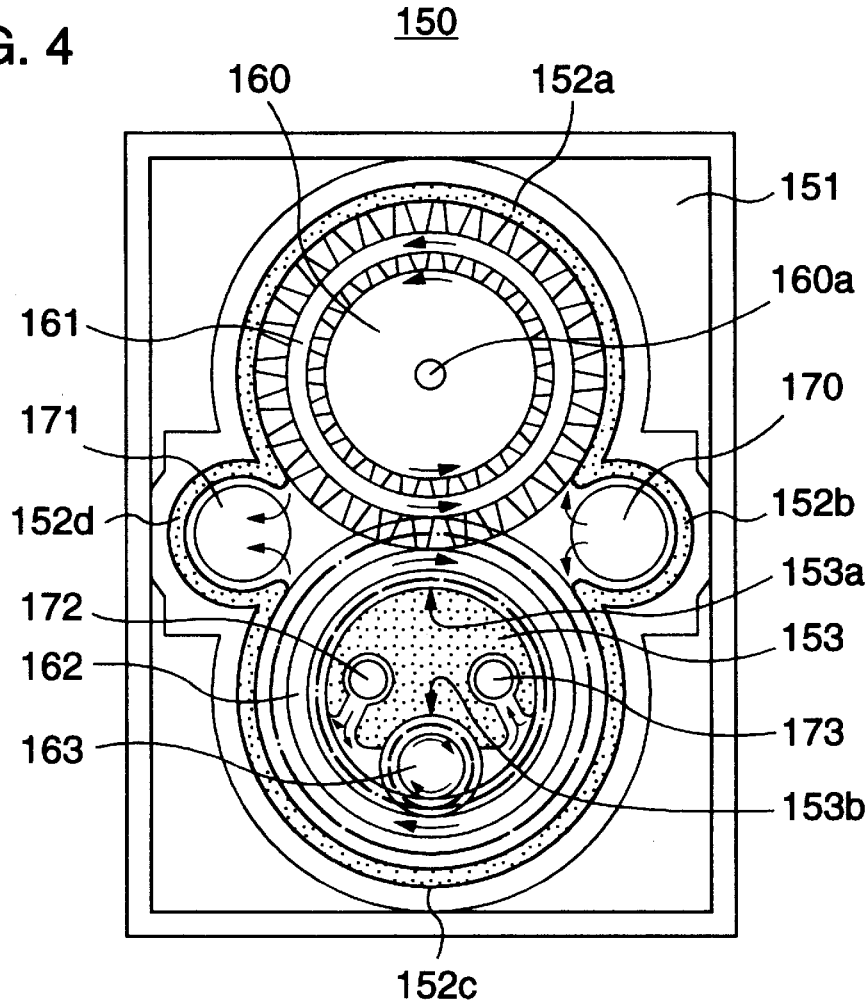
FIG. 4 is a front view of the internal structure of a gear pump for the feed and recovery of a liquid toner in an electrostatic recorder according to the present invention.
Figure 5:
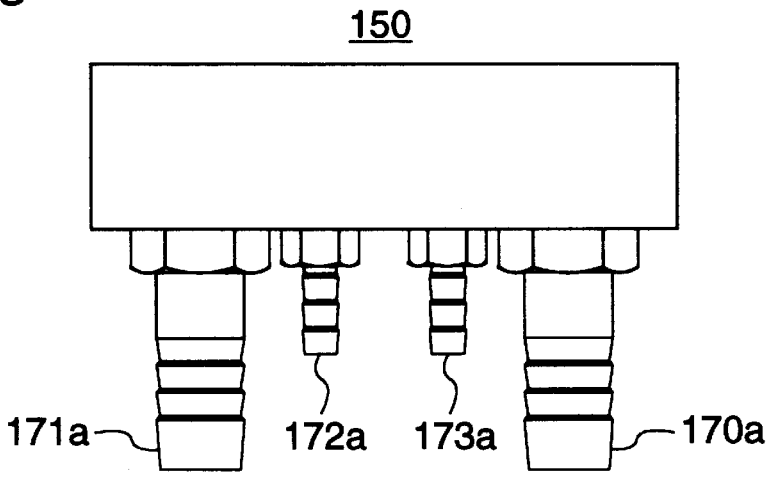
FIG. 5 is a bottom view of the gear pump of FIG. 4.
Figure 6:
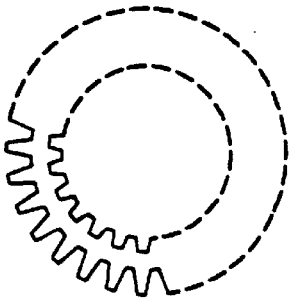
FIG. 6 is an illustration of one gear in the gear pump of FIG. 4.
Figure 8:
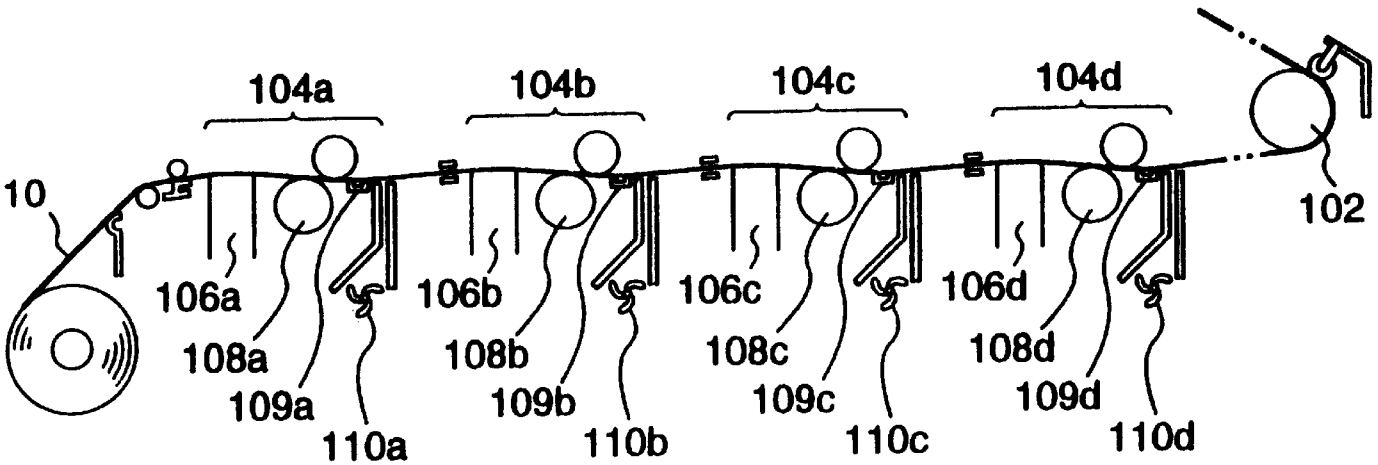
FIG. 8 is a schematic sectional view of a conventional electrostatic recorder.

Next, a gear pump for the electrostatic recorder (hereinafter, referred to as "gear pump"), the principal part of still another embodiment of the present invention, will be described. FIG. 4 is a partly omitted front view showing the internal structure of a gear pump 150, FIG. 5 is a bottom view of a gear pump 150 and FIG. 6 is an illustration of the shape of a gear 161 (or gear 162). Incidentally, for simplicity, the teeth of the gears 162 and 163 are omitted in FIG. 4 and only about a quarter of the teeth of the gear 161 (or gear 162) are depicted.

The case 151 preferably has a size of approx. 70 mm in width and approx. 90 mm in length, and in the interior, a region surrounded with an approx. 10 mm high side walls 152*a* to 152*d* is provided, while an approx. 10 mm high upheaval 153 is formed at the center of the side wall 152*c*. In the space formed with the side walls 152*a* to 152*d* and the upheaval 153, gears 160 to 163 are rotatably disposed. Among these, the gear 160 is a gear for transmitting the rotational driving force of a motor to the gear 161. The gear 161 is a first gear according to the present invention, the gear 162 is a second gear according to the present invention and the gear 163 is a third gear according to the present invention. Incidentally, when the gear pump 150 is actuated, a planar cover is mounted at the top to tightly seal the interior.

The gears 161 to 163 are all approx. 10 mm in thickness. The gears 161 and 162 are equal in shape and size, and teeth are provided in the inner and outer peripheries as shown in FIG. 6. These inner teeth and outer teeth are equal in number and so formed that the inner tooth flank comes to the outer tooth crest. This is because the thickness of a gear is made as constant as possible so that a change in strength with different places is minimized.

The position of the gear 161 is defined by the side wall 152*a* and the outer teeth thereof come in sliding contact with the side wall 152*a*. The position of the gear 162 is defined by the side wall 152*c* and the upheaval 153, the outer teeth thereof come in sliding contact with the side wall 152*c* and the inner teeth come in sliding contact with the wall 153*a* of the upheaval 153. And, the position of the gear 163 is defined by the upheaval 153 and the gear 162, the teeth thereof come in sliding contact with the side wall 153*b* of the upheaval 153. Incidentally, the gear 160 is made of metal. On the other hand, the gears 161, 162 and 163 are obtained by molding from a raw material such as, e.g., phenol resin or polyacetal and annealed thereafter. At that time, to raise the wear resistance, silica may be mixed.

The gear 160 is rotationally driven counterclockwise around the center axis 160*a,* for example, at a rate of 300 r.p.m. by means of a motor not shown. Teeth of the gear 160 and inner teeth of the gear 161 are engaged with each other, outer teeth of the gear 161 and outer teeth of the gear 162 are engaged with each other and further inner teeth of the gear 162 and teeth of the gear 163 are engaged with each other. Accordingly, when the gear 160 is rotationally driven counterclockwise by means of a pump, the gear 161 rotates counterclockwise, the gear 162 rotates clockwise and the gear 163 rotates clockwise.

In the case 151, as shown in FIG. 4, four openings 170, 171, 172 and 173 are further provided. As shown in FIG. 5, these openings couple with corresponding insert ports 170*a*, 171*a*, 172*a* and 173*a* provided so as to protrude in the rear side direction. To individual insert ports, corresponding hoses are inserted. The opening 170 couples through the insert port 170*a* with a toner bottle (not shown) in which a liquid toner is stored and the opening 171 couple through the insert port 171*a* with the aforesaid toner feed tray 30. Since the counterclockwise rotation of the gear 161 and the clockwise rotation of the gear 162 will make the space (center right space) surrounded with the side wall 152*b* and the gears 161, 162 into a negative pressure, a liquid toner is sucked from the toner bottle and flows through the opening 170 into the gear pump. This liquid toner enters between outer teeth of the rotating gears 161 and 162, is carried to the space (center left space) surrounded with the opposite side wall 152*d* and the gears 161, 162, pressurized here and delivered from the opening 171 to the toner feed tray 30. In this manner, one pumping route leading from the opening 171 to the opening 171 is formed. Incidentally, at the route leading from the opening 171 to the toner feed tray 30, a pressure regulating valve not shown is provided. When the pressure in this route exceeds a fixed value, the pressure regulating valve operates to let air or toner off, thus lowering the internal pressure. By the function of the pressure regulating valve, the pressure in this route is always kept nearly constant. Furthermore, at the toner suction route from the opening 172 to the suction section 23, a pressure regulating valve is also provided so that a definite negative pressure is prevented from occurring.

The opening 172 couples through the insert port 172*a* with the suction path 33 of the suction section 23 for removing the unnecessary toner not contributing to the development from the recording medium after the development and the opening 173 couples through the insert port 172*a* with a recycling device for liquid toner. Since the clockwise rotation of the gears 162 and 163 will make the space on the left side of the gear 163 into a negative pressure, the liquid toner is sucked in the suction section 23 and the air blown in flows into the opening 172. The liquid toner and air enters between inner teeth of the rotating gear 162 and between teeth of the rotating gear 163, is carried to the space on the right side of the gear 163, pressurized here and discharged from the opening 173 to a toner recycling device not shown. In this manner, a pumping route leading from the opening 172 to the opening 173, separated from and independent of the above-mentioned pumping routes is formed. Incidentally, at the route coupling from the opening 173 with the toner recycling device, a pressure regulating valve not shown is also provided. By the function of this pressure regulating valve, the pressure in this route is always kept nearly constant.

Meanwhile, it is known that, when plenty of air bubbles are mixed in the liquid toner to be fed to the toner feed tray 30, the liquid toner applied to the recording medium 10 is rippled and consequently an unevenness occurs in print images, thus deteriorating the image quality. With a gear pump according to this embodiment, however, as mentioned above, the region surrounded with the side walls 152*a* to 152*d* and the outer peripheries of the gears 161 and 162 and the region of the inner periphery of the gear 162 are completely separated, while the liquid toner feed route and the liquid toner recovery route are independent. Accordingly, the route of the liquid toner discharged from the toner bottle to the toner feed tray 30 and that of the liquid toner recovered from the suction section 23 are not joined and air of the liquid toner recovered from the suction section 23 is not mixed into the liquid toner to be delivered to the toner feed tray 30. Thus, the liquid toner applied to the recording medium is not rippled and high-quality print images are obtained.

In addition, as shown in FIG. 4, the pump for delivering a liquid toner to the toner feed tray 30 and the pump for sucking the unnecessary liquid toner from the suction section 23 comprise a single gear pump and moreover, because of its simple structure, this is unlikely to get out of order and can be downsized. Furthermore, since such a conventional aspirator becomes unnecessary and only one motor is needed for the drive of this gear pump, the cost-saving is also attainable.

Meanwhile, the present invention is not limited to the embodiment mentioned above, but may be subjected to various modifications and variations within its scope.

For example, with the embodiment mentioned above, the gear 160 is connected to a motor, through which the gear 161 is rotationally rotated by means of the motor, but instead, the gear 163 provided inside the gear 162 may be rotated.

As described above, according to the present invention, by having first to third gears provided, having the first gear provided outside the second gear and having the third gear provided inside the second gear among them, a first region and a second region are separated and the pumping route provided in the first region and the pumping route provided in the second region become completely independent, so that the fluids passing through these routes are never mixed with each other. Accordingly, by selecting one as the feed route of the liquid toner for development and the other as the recovery route of the unnecessary liquid toner after the development out of these two routes, the recovered liquid toner with air bubbles mixed therein and the liquid toner for development can be pumped without mutual mixing and thus it is effectively prevented that the liquid toner for development is rippled with the mixing of air to deteriorate the image quality. Besides this, if such two-path pumping operations are performed in a simple structure by means of one pump, an aspirator and such others become unnecessary and therefore it is possible to provide an electrostatic recorder in which the downsizing of apparatus and cost cut are attained.

An electrostatic recorder according to the present invention can execute the development of electrostatic latent images formed on a recording medium by using a liquid toner. This electrostatic recorder is suitable especially for a color electrostatic recorder of the single path scheme allowing a recording medium to continuously pass a plurality of recording sections and development sections.

What is claimed is:

1. An electrostatic recorder comprising:

electrostatic latent image recording means for forming an electrostatic latent image on a recording medium conveyed at a predetermined speed;

toner feed means having a toner feed route for feeding a toner to a surface of said recording medium on which an electrostatic image is formed; and toner recovery means having a toner recovery route for recovering an excess of toner stuck to said recording medium; wherein said toner recovery means can execute the recovery of an excess of toner not only by suction but also by scraping from the recording medium prior to this suction and said toner recovery means is provided with means for eliminating the mixing of foreign matters into the feed means in conjunction with said recovered toner.

2. The electrostatic recorder as set forth in claim 1, wherein said electrostatic latent image recording means, said toner feed means, and said toner recovery means make one set out of a plurality of sets, said sets are arranged in series and a color image can be obtained by a single path of those sets.

3. The electrostatic recorder as set forth in claim 1, wherein said toner recovery means comprises toner removal means, provided between said toner feed means and suction means for performing the recovery of an excess of toner by suction, for scraping off an excess of toner from the recording medium.

4. The electrostatic recorder as set forth in claim 1, wherein said toner is a liquid toner, said recovery means comprises a feed route for said liquid toner, a recovery route and a toner reservoir of a large capacity, and that said toner recovery route and said toner feed route communicate with the top and bottom of said toner reservoir, respectively.

5. The electrostatic recorder as set forth in claim 1, wherein said toner feed route and said toner recovery route are connected to a gear pump comprising a first gear, a second gear and a third gear which is formed inside of said first gear, respectively so as to perform the feed and recovery of toner.

6. An electrostatic recorder comprising, electrostatic latent image recording means for forming an electrostatic latent image on a recording medium conveyed at a predetermined speed, toner feed means for feeding a liquid toner to a surface of said recording medium on which an electrostatic image is formed;

suction means for sucking an unnecessary liquid toner from said recording medium to which a liquid toner sticks; and liquid toner removal means provided between said toner feed means and said suction means for scraping a liquid toner while kept in sliding contact with the record face of the recording medium conveyed, characterized in a greater part of unnecessary liquid toner is removed in advance before the recording medium reaches said suction means.

7. The electrostatic recorder as set forth in claim 6, wherein said liquid toner removal means comprises a bar of nearly circular section.

8. The electrostatic recorder as set forth in claim 6, further comprising:

liquid toner recovery means for recovering the liquid toner scraped off in said liquid toner removal means and the unnecessary liquid toner sucked from said recording medium.

9. An electrostatic recorder comprising, electrostatic latent image recording means for forming an electrostatic latent image on a recording medium conveyed at a predetermined speed;

toner feed means for feeding a liquid toner to a surface of said recording medium on which an electrostatic image is formed; and toner recovery means for recovering an unnecessary toner from said recording medium, wherein said toner feed means comprises a toner feed route, a toner recovery route connected to said toner recovery means and a toner reservoir of a large capacity separated from said electrostatic recorder and that said liquid toner recovery route is so arranged as to communicate with the top of said recovery means and moreover the tip of said toner feed route is so arranged so as to be situated near the bottom of said recovery means.

10. An electrostatic recorder comprising:

electrostatic latent image recording means for forming an electrostatic latent image on a recording medium conveyed at a predetermined speed;

development means for developing the electrostatic latent image formed on said recording medium;

toner feed means for feeding a liquid toner to a surface of said recording medium in said development means, and toner recovery means for recovering an unnecessary toner from said recording medium, wherein said toner feed means comprises, an internal reservoir provided inside the main body of said electrostatic recorder, equipped with a first toner feed route for feeding a liquid toner to said development means and a first toner recovery route for recovering the liquid toner after the development, and an external reservoir provided outside the main body of said electrostatic recorder, equipped with a second toner feed route for feeding a liquid toner to said internal reservoir and a second toner recovery route for returning the liquid toner recovered from said internal reservoir wherein said second toner recovery route is so arranged as to communicate with the top of said external reservoir and moreover the tip of said second toner feed route is so arranged so as to be situated near the bottom of said external reservoir.

11. The electrostatic recorder as set forth in claim 10, further comprising:

an intra-reservoir reservoir placed inside said internal reservoir and communicating with said internal reservoir through an overflow exhaust port, wherein said first toner feed route is made to communicate with the interior of said intra-reservoir reservoir and said second toner feed route is made to communicate with said intra-reservoir reservoir, and the liquid toner in said intra-reservoir reservoir is made into an overflow state and is fed through said external reservoir, said second toner feed route, said intra-reservoir reservoir and said first toner feed route to said development means and the liquid toner after use is recovered through said first toner recovery route, said internal reservoir and said second toner recovery route to the external reservoir.

12. The electrostatic recorder as set forth in claim 10, wherein a float sensor is provided in said internal reservoir and the liquid surface level of a liquid toner in said internal reservoir is maintained at a nearly constant level by controlling the feed amount of a liquid toner through said second toner feeder route and the recovery amount of a liquid toner through said second toner recovery route.

13. The electrostatic recorder as set forth in claim 10, wherein said toner feed means further comprises a gear pump having a first and second gears with their outer teeth engaged with each other and a third gear inside the second gear so arranged as that its outer teeth are engaged with the inner teeth of said second gear, said gear pump comprising, a first suction path provided on one side and a first discharge path provided on the other side relative to the engaged portion of both teeth outside said first and second gears, and a second suction path provided on one side and a second discharge path provided on the other side relative to the engaged portion of both teeth inside said second gear and outside the third gear, said gear pump pumping out a first fluid through said first suction path and said first discharge path by a rotation of said first to third gears in a predetermined direction and pumping out a second fluid through said second suction path and said second discharge path by the rotation of said first to third gears.

14. The electrostatic recorder as set forth in claim 13, wherein said gear pump is actuated by a rotational drive of said first gear.

15. The electrostatic recorder as set forth in claim 13, wherein said first gear has teeth provided on the inner periphery thereof, a fourth gear to engage with the teeth provided on the inner periphery of said first gear is provided inside said first gear, and said first gear is rotationally driven through said fourth gear.

16. The electrostatic recorder as set forth in claim 13, wherein said gear pump is actuated by a rotational drive of said third gear.

17. The electrostatic recorder as set forth in claim 4, wherein said toner feed route and said toner recovery route are connected to a gear pump comprising a pair of gears and a gear pump comprising a pair of gears formed inside one of said gears, respectively so as to perform the feed and recovery of toner.

18. The electrostatic recorder as set forth in claim 11, wherein a float sensor is provided in said internal reservoir and the liquid surface level of a liquid toner in said internal reservoir is maintained at a nearly constant level by controlling the feed amount of a liquid toner through said second toner feeder route and the recovery amount of a liquid toner through said second toner recovery route.

19. The electrostatic recorder as set forth in claim 11, wherein said toner feed means further comprises a gear pump having a first and second gears with their outer teeth engaged with each other and a third gear inside the second gear so arranged as that its outer teeth are engaged with the inner teeth of said second gear, said gear pump comprising, a first suction path provided on one side and a first discharge path provided on the other side relative to the engaged portion of both teeth outside said first and second gears, and a second suction path provided on one side and a second discharge path provided on the other side relative to the engaged portio of both teeth inside said second gear and outside the third gear, said gear pump pumping out a first fluid through said first suction path and said first discharge path by a rotation of said first to third gears in a predetermined direction and pumping out a second fluid through said second suction path and said second discharge path by the rotation of said first to third gears.

* * * * *